US007665970B2

(12) United States Patent
Pearce

(10) Patent No.: US 7,665,970 B2
(45) Date of Patent: Feb. 23, 2010

(54) FAN BLADE MOUNTING SYSTEM

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 576 days.

(21) Appl. No.: 11/655,393

(22) Filed: Jan. 18, 2007

(65) Prior Publication Data

US 2008/0175715 A1 Jul. 24, 2008

(51) Int. Cl.
*F04D 29/34* (2006.01)

(52) U.S. Cl. ..... 416/205; 416/5; 416/210 R

(58) Field of Classification Search ..... 416/5, 416/144, 145, 131, 205, 210 R
See application file for complete search history.

(56) References Cited

U.S. PATENT DOCUMENTS

| | | | | |
|---|---|---|---|---|
| 2,383,002 | A | 8/1945 | Mader | |
| 3,551,070 | A | 12/1970 | Glucksman | |
| 4,511,310 | A | 4/1985 | Pearce | |
| 4,634,345 | A | 1/1987 | Stanek et al. | |
| D312,688 | S | 12/1990 | Mason | |
| D323,384 | S | 1/1992 | Mason | |
| D324,100 | S | 2/1992 | Holbrook | |
| D325,776 | S | 4/1992 | Scofield et al. | |
| D328,947 | S | 8/1992 | Holbrook | |
| 5,222,864 | A | 6/1993 | Pearce | |
| 5,297,936 | A | 3/1994 | Sato | |
| D346,209 | S | 4/1994 | Holbrook | |
| 5,304,037 | A | 4/1994 | Scofield | |
| D349,336 | S | 8/1994 | Tsuji | |
| D354,804 | S | 1/1995 | Tsuji | |
| 5,380,156 | A | 1/1995 | Iacovino | 416/5 |
| D357,978 | S | 5/1995 | Young | |
| D358,877 | S | 5/1995 | Tsuji | |
| D361,377 | S | 8/1995 | Tsuji | |
| 5,462,412 | A | 10/1995 | Scofield et al. | |
| D367,321 | S | 2/1996 | Holbrook | |
| 5,501,010 | A | 3/1996 | Scott | |
| 5,593,281 | A | 1/1997 | Tai | 416/145 |
| 5,593,283 | A | 1/1997 | Scott | |
| 5,944,487 | A | 8/1999 | Pearce | |
| 6,364,612 | B1 * | 4/2002 | Tseng | 416/210 R |
| 6,382,917 | B1 | 5/2002 | Zuege | |
| 6,857,854 | B2 | 2/2005 | Pearce | |
| 6,863,499 | B2 | 3/2005 | Pearce | |
| 6,902,375 | B2 | 6/2005 | Bird et al. | |
| 6,932,576 | B2 | 8/2005 | Bird | |

FOREIGN PATENT DOCUMENTS

| | | |
|---|---|---|
| GB | 2018392 | 10/1979 |

* cited by examiner

*Primary Examiner*—Edward Look
*Assistant Examiner*—Dwayne J White
(74) *Attorney, Agent, or Firm*—Baker Donelson

(57) ABSTRACT

A ceiling fan (10) is disclosed having a motor housing (11) which encases an electric motor (13). The motor includes a bottom mounting plate (14) that rotates and thereby drives an annular array of blade irons (16), each having a blade (17) mounted thereto in conventional fashion. Each blade iron is mounted for pivotal and radial movement relative to the bottom mounting plate. An annular balancing ring (28) causes pivotal and radial movement of other blade irons (36)in response to the radial movement of an off-balanced blade iron (35).

19 Claims, 3 Drawing Sheets

FAN BLADE MOUNTING SYSTEM

TECHNICAL FIELD

This invention relates to a fan system for mounting blade irons, and specifically to systems for automatically balancing the blade irons and blades of a fan.

BACKGROUND OF THE INVENTION

Many different types of fans exist today, such as ceiling fans, table fans, pedestal fans, and fans used in conjunction with mechanical equipment. Most of these fans include a blade and a blade mount or blade iron which couples the blade to the motor.

Electrically powered ceiling fans typically have a motor mounted within a stationary housing that is suspended from a ceiling. In operation, the motor rotates an annular array of individual extensions in the form of blade mounts or blade irons. Each blade iron is associated with a blade mounted thereto.

The blades of ceiling fans are usually coupled to the blade irons by passing mounting screws through holes in the blade and into threaded holes in the blade iron. The blade irons are then mounted to the motor.

Fan blade imbalance and the associated ceiling fan wobble may result from a variety of off-balanced or imbalanced discrepancies associated with the ceiling fan blades, including variations in blade pitch angle, dihedral angle, uneven circumferential spacing between adjacent blade pairs, blade warpage and uneven radial spacing of the blades from the vertical axis of rotation. Ceiling fan wobble, and the associated vibration, creates undesirable noise, is visually distracting, and may adversely affect the service life of the ceiling fan.

Accordingly, it is seen that a need remains for a ceiling fan system that can be quickly and easily balance the rotating blades. It is to the provision of such therefore that the present invention is primarily directed.

SUMMARY OF THE INVENTION

In a preferred form of the invention a fan comprises an electric motor, a balancing member coupled to the motor for limited radial movement of the balancing member relative to the motor, an annular array of blade irons mounted to the motor for pivotal and radial movement relative to the motor, and a ceiling fan blade associated with each blade iron of the annular array of blade irons. Each blade iron has an end pivotally mounted to the balancing member, With this construction, the off balanced movement of a blade iron causes the radial movement of the balancing member, which in turn causes the pivotal and radial movement of the other blade irons toward an equilibrium position.

DETAILED DESCRIPTION

Figure 1:
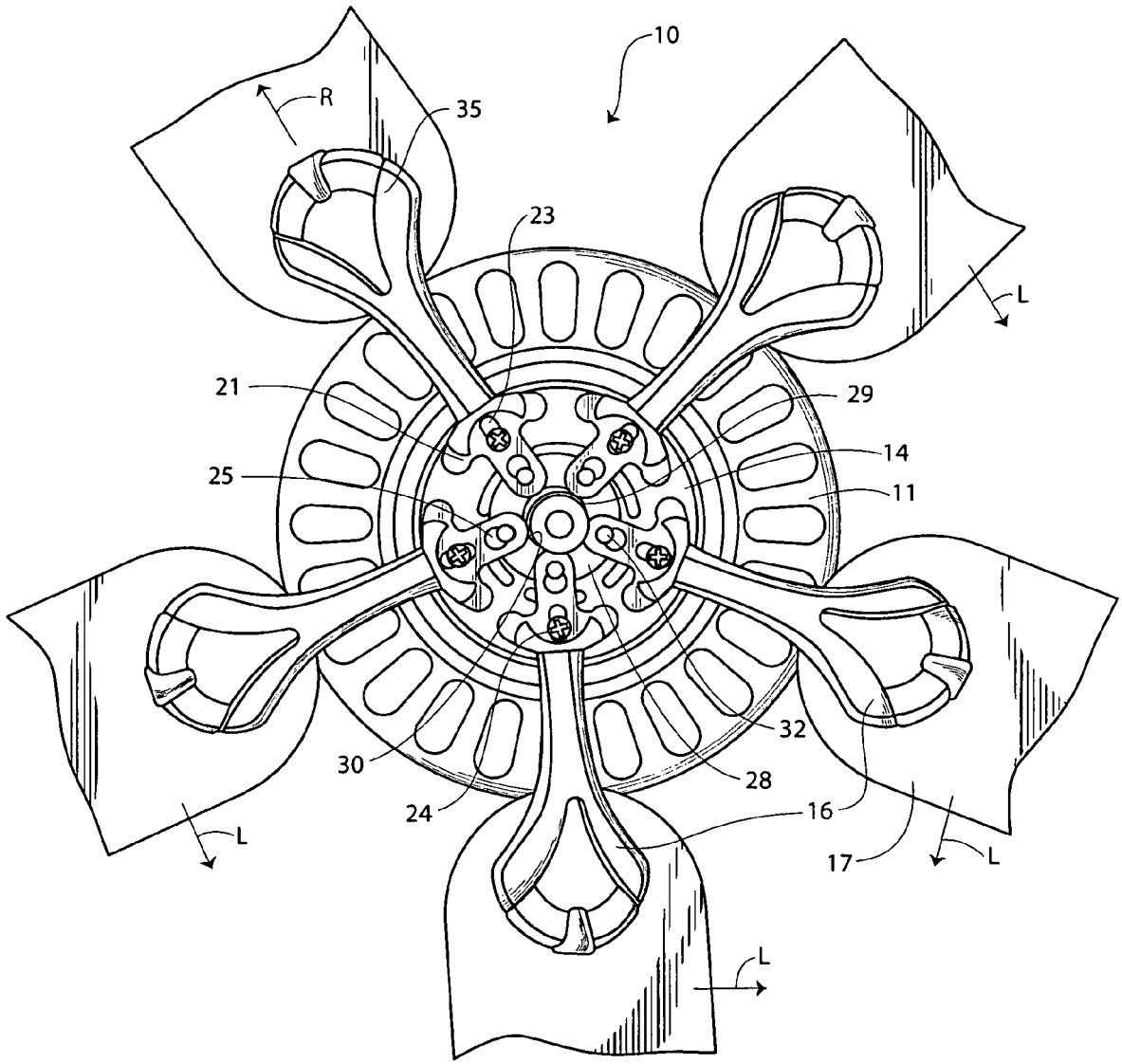
FIG. 1 is a bottom view of a ceiling fan embodying principles of the invention in a preferred form.
Figure 2:
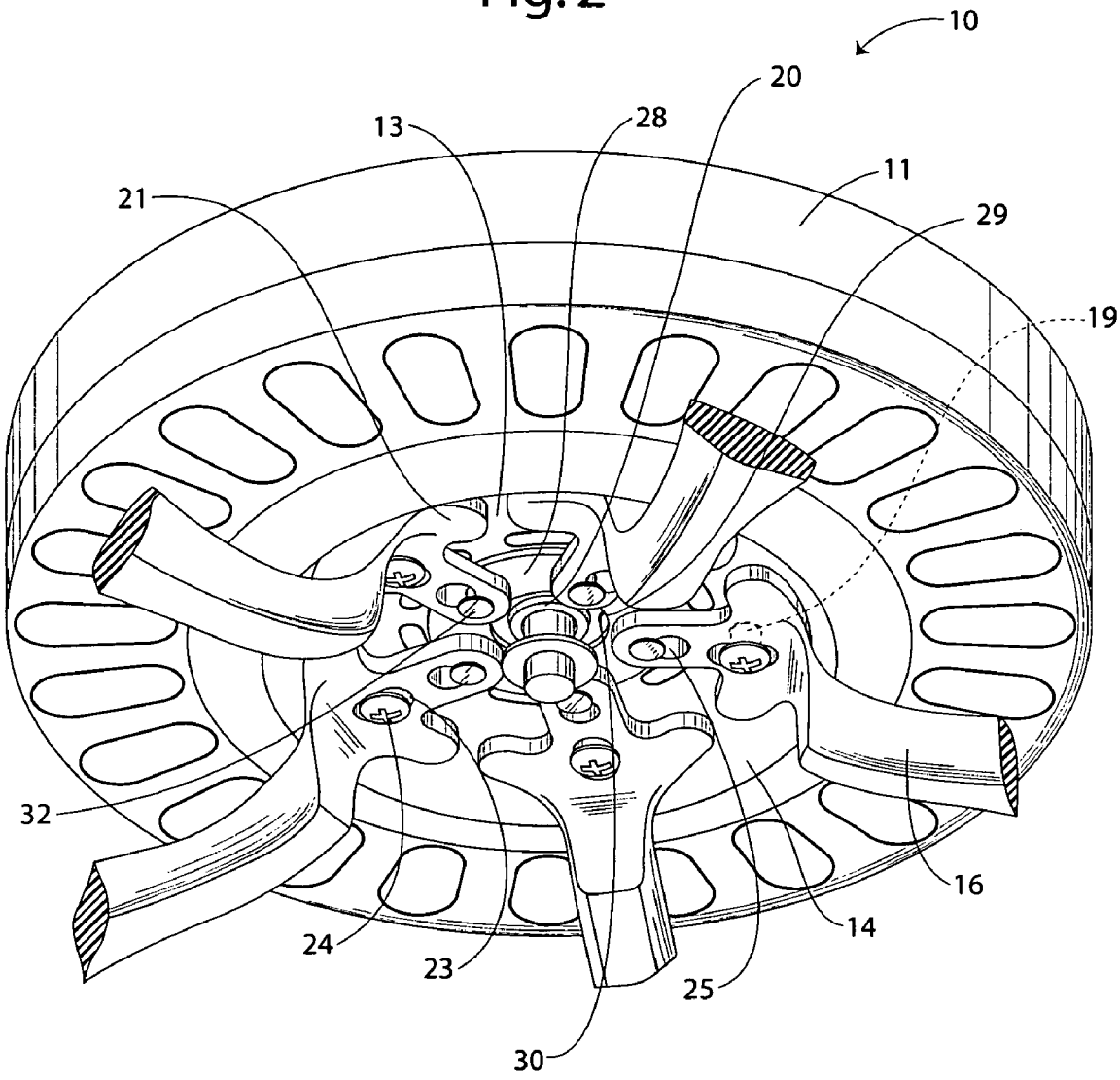
FIG. 2 is a perspective view of a portion of the ceiling fan of FIG. 1.

With reference next to the drawings, there is shown a ceiling fan 10 having a motor housing 11 which encases an electric motor 13 connected to a source of electric power by unshown wires. The motor 13 includes a bottom mounting plate 14 that rotates and thereby drives an annular array of blade irons 16, each having a blade 17 mounted thereto in conventional fashion. The motor bottom mounting plate 14 has an annular array of threaded mounting holes 19 and a centrally positioned, raised, annular stop 20.

Each blade iron 16 has a motor mounting flange 21 configured to be coupled with the bottom mounting plate 14 of the electric motor 13. The mounting flange 21 has an elongated slot 23 therethrough which is aligned with the threaded mounting hole 19 of the bottom mounting plate 14. A retaining member in the form of a mounting bolt or screw 24 extends through the elongated slot 23 and is threadably received in the mounting hole 19. The mounting screw 24 however allows radial and pivotal movement of the blade iron 16 relative to the bottom mounting plate 14 of the motor. The motor mounting flange 21 also includes a keyhole shaped hole 25.

The ceiling fan 10 also includes an annular balancing member in the form of a balancing ring 28 positioned concentrically about the annular stop 20. The concentric positioning of the balancing ring allows for limited movement relative to the bottom mounting plate 14. The central hole 29 within the balancing ring is defined by inner walls 30 which contacts the annular stop 20 to limit the radial movement of the balancing ring 28. The balancing ring 28 includes an annular array of rivets 32 which are received withing the keyhole shaped hole 25 of the blade irons 16.

Figure 3:
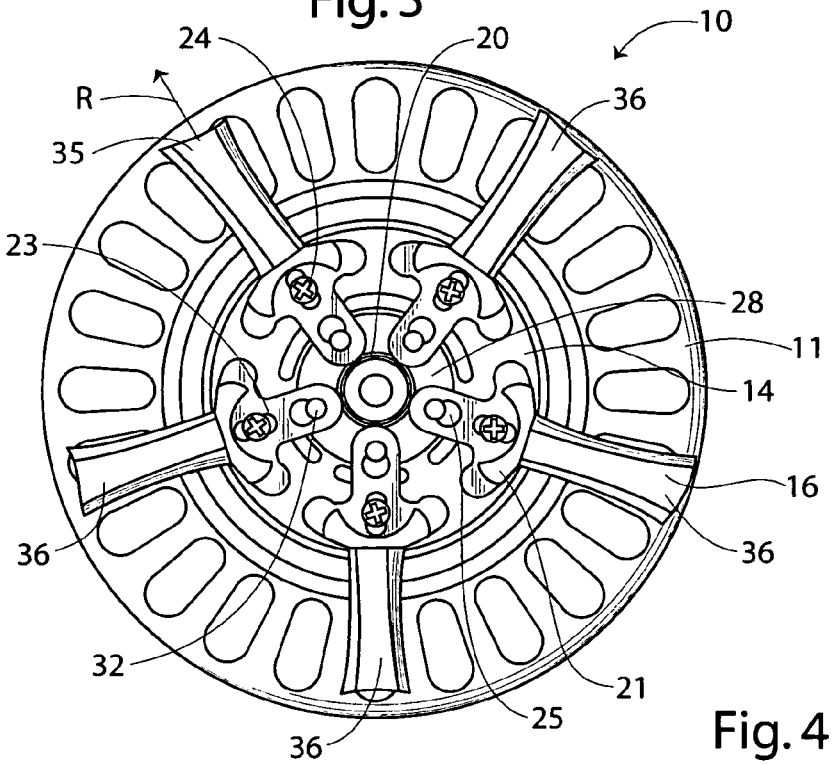
FIG. 3 is a bottom view of a ceiling fan of FIG. 1.

In use, the balancing ring 28 initially is centrally positioned so that the blade irons are equally spaced from the center point of the bottom mounting plate 14, as shown in FIG. 3. The operation of the motor 13 rotates the motor bottom mounting plate 14, thereby rotating the blade irons 16 and blades 17, creating a centrifugal force upon each blade iron. Should a heavier combined blade iron and blade 35 cause an imbalance due to it having a weight greater (resulting in a greater centrifugal force) than the other combinations of blade irons and blades 36, the ceiling fan automatically balances itself in a manner described in more detail hereinafter. Of course, other factors previously recited may also cause an off-balancing of a combined blade iron and blade, for ease of description described hereinafter as simply the blade iron.

Figure 4:
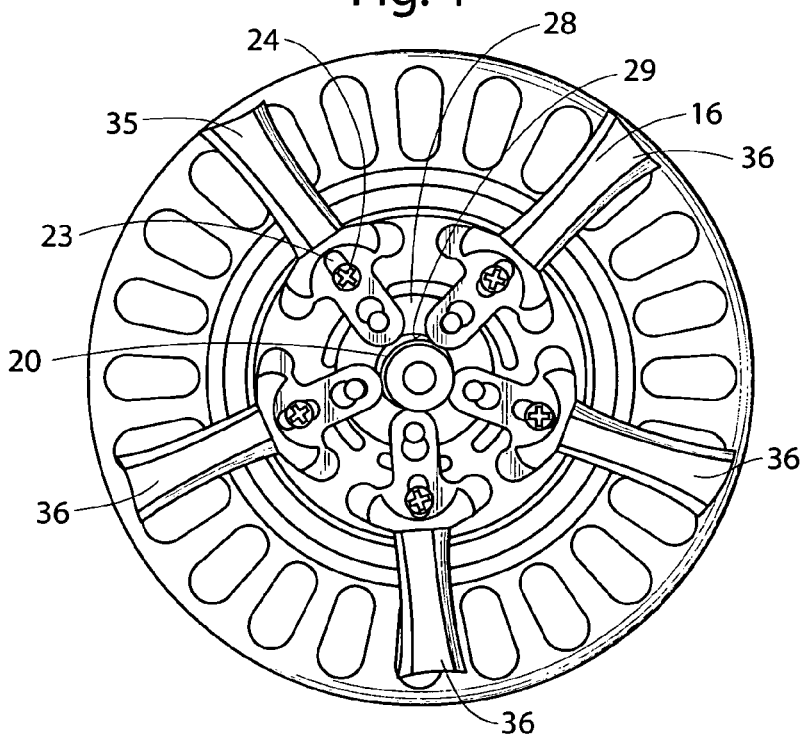
FIG. 4 is a bottom view of a ceiling fan of FIG. 1.

As shown in FIG. 4, the ceiling fan corrects this off-balancing by establishing an equilibrium balance through the subsequent relative movements of the blade irons. Here, the heavier blade iron 35 moves in an outboard direction from the center of the bottom mounting plate 14 because of its relative weight. The outboard movement of the heavier blade iron 35 is illustrated by arrow H. The outboard movement of the heavier blade iron 35 forces the balancing ring 28 coupled therewith to move outboard in relatively the same direction, as illustrated by arrow R.

The outboard movement of the balancing ring 28 in direction H causes the other blade irons 36 to pivot and/or longitudinally move in an "opposite" direction to the movement of the heavier blade iron 35, as indicated by arrows L. The term opposite is intended to denote a direction generally away from the direction of the heavier blade iron 35 eventhough such movement is not 180 degrees in the opposite direction. For example, the movement of the two oppositely disposed blade irons 36 is indicated by arrows L, which is shown to be approximately 120 degrees from the direction of arrow H. The term opposite direction may mean a direction as little as 91 degrees offset from direction H.

The pivotal movement of the other blade irons 36 is caused by the pulling action on the blade irons 36 by rivets 32 as the balancing ring 28 moves in direction R and the blade irons are forced to pivot about mounting screws 24. Similarly, the longitudinal movement of the other blade irons 36 is provided through the pulling action on the blade irons by rivets 32 thereby causing the blade irons to move relative to mounting screws 24 along the elongated slots 23. As such, each mounting screw 24 and slot 23 establishes a first pivot about which the blade iron pivotally and radially moves relative to the motor, while the rivet 32 and keyhole shaped hole 25 establish a second pivot about which the blade iron pivotally moves relative to the balancing ring 28.

The movement of the other blade irons 36 in a direction opposite to the direction of the heaviest blade iron counterbalance the outboard movement of the heavier blade iron 35, thereby establishing an equilibrium balance upon the entire system. This equilibrium balance of the rotating blade irons/blades restricts the wobbling motion of the ceiling fan due to an off balanced blade iron and/or blade.

It should be understood that the rivets 32 may also be in the form of posts, screws, bolts, or other movement limiting means.

It should be understood that the current invention is not intended to be limited to ceiling fans and may apply equally to all types of fans.

It should be understood that the stop 20 may be in the other forms such as seats, walls, flanges, posts, screws within oversized holes, or other obstructions. These stops may also be positioned within or outside of the balancing member, so long as they allow but limit radial movement of the balancing member.

It should be understood that the system will work equally for more than one blade iron and blade combination being off-balanced, as the entire system will move to an equilibrium position.

It thus is seen that a ceiling fan is now provided which balances itself. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A fan comprising, an electric motor;

a balancing member coupled to said motor for limited radial movement of said balancing member relative to said motor;

an annular array of blade irons, each said blade iron being mounted to said motor for pivotal and radial movement relative to said motor, each said blade iron also has an end pivotally mounted to said balancing member; and a ceiling fan blade associated with each said blade iron of said annular array of blade irons, whereby the off balanced movement of a blade iron causes the radial movement of the balancing member, which in turn causes the pivotal and radial movement of the other blade irons towards an equilibrium position.

2. The fan of claim 1 wherein said motor includes a stop and wherein said balancing member is configured to engage said stop.

3. The fan of claim 2 wherein said balancing member is a ring which includes a central hole configured to engage said stop.

4. The fan of claim 1 wherein each said blade iron includes an elongated slot, and wherein a retaining member extends through said elongated slot and is coupled to said motor to allow pivotal and radial movement of said blade iron relative to said motor.

5. A ceiling fan comprising, an electric motor;

an annular array of combined blade irons and blades coupled to said motor;

a balancing system coupled to each said combined blade irons and blades, said balancing system pivotally and radially moving select combined blade irons and blades in a direction generally opposite to the direction of movement of an off-set combined blade iron and blade, whereby an equilibrium balance is provided by the pivotal and radial movements of the combined blade irons and blades.

6. The fan of claim 5 wherein said balancing system includes a balancing member coupled to said motor for limited radial movement of said balancing member relative to said motor.

7. The fan of claim 6 wherein said motor includes a stop and wherein said balancing member engages said stop to restrict radial movement of said stop relative to said motor.

8. The fan of claim 7 wherein said balancing member is a ring which includes a central hole configured to engage said stop.

9. The fan of claim 5 wherein each said blade iron includes an elongated slot, and wherein a retaining member extends through said elongated slot and is coupled to said motor to allow pivotal and radial movement of said blade iron relative to said motor.

10. A fan comprising, an electric motor;

a balancing member coupled to said motor for limited radial movement of said balancing member relative to said motor;

an annular array of blade irons coupled to said motor, each said blade iron having a mounting member which allows pivotal and radial movement of said blade iron relative to said motor and a pivot member pivotally coupling said blade iron to said balancing member; and a ceiling fan blade associated with each said blade iron of said annular array of blade irons, whereby the off balanced movement of a blade iron causes the radial movement of the balancing member, which in turn causes the pivotal and radial movement of the other blade irons.

11. The fan of claim 10 wherein said motor includes a stop and wherein said balancing member is configured to engage said stop.

12. The fan of claim 11 wherein said balancing member is a ring configured to engage said stop.

13. The fan of claim 12 wherein said ring includes a central hole configured to engage said stop.

14. The fan of claim 10 wherein each said blade iron includes an elongated slot, and wherein said mounting member is a retaining member extending through said elongated slot and coupled to said motor to allow pivotal and radial movement of said blade iron relative to said motor.

15. A fan comprising, an electric motor;

a balancing member mounted adjacent said motor for limited radial movement of said balancing member relative to said motor;

an annular array of blade irons coupled to said motor, each said blade iron having a first pivot allowing pivotal movement of said blade iron relative to said motor and a second pivot allowing pivotal movement of said blade iron relative to said balancing member; and a ceiling fan blade associated with each said blade iron of said annular array of blade irons, whereby the off balanced movement of a blade iron causes the radial movement of the balancing member, which in turn causes the pivotal and radial movement of the other blade irons towards an equilibrium position.

16. The fan of claim 15 wherein said motor includes a stop and wherein said balancing member is configured to engage said stop.

17. The fan of claim 16 wherein said balancing member is a ring which includes a central hole configured to engage said stop.

18. The fan of claim 15 wherein said first pivot is an elongated slot and a retaining member extending through said elongated slot and coupled to said motor.

19. The fan of claim 15 wherein said first pivot allows radial movement of said blade iron relative to said motor.

* * * * *